United States Patent [19]

Filipowski

[11] Patent Number: 4,884,626

[45] Date of Patent: Dec. 5, 1989

[54] COMBINATION REFRIGERATOR OVEN

[76] Inventor: Merle M. Filipowski, 237 Beachers Brook La., Cary, N.C. 27511

[21] Appl. No.: 89,265

[22] Filed: Aug. 25, 1987

Related U.S. Application Data

[63] Continuation-in-part of Ser. No. 846,853, Apr. 1, 1986, abandoned, which is a continuation of Ser. No. 747,797, Jun. 24, 1985, abandoned.

[51] Int. Cl.[4] ..... F25B 29/00

[52] U.S. Cl. ..... 165/12; 165/48.1; 165/63; 165/64; 165/918; 374/158; 99/357; 99/419; 99/484; 312/236; 219/10.55 R; 219/10.55 B

[58] Field of Search ..... 165/12, 918, 919, 58, 165/48.1, 61, 63, 64; 219/10.55 R, 10.55 B; 374/158; 99/357, 419, 484; 312/236

[56] References Cited

U.S. PATENT DOCUMENTS

| | | | |
|---|---|---|---|
| 339,176 | 4/1886 | Hempel | 374/158 |
| 2,091,292 | 8/1937 | Scurlock | 165/58 |
| 2,504,794 | 4/1950 | Bern et al. | 165/918 |
| 2,616,269 | 11/1952 | Reynolds | 62/89 |
| 2,823,902 | 2/1958 | Reynolds . | |
| 3,048,928 | 8/1962 | Copson et al. | 219/10.55 R |
| 3,320,396 | 5/1967 | Boehm | 219/10.55 B |
| 3,353,476 | 11/1967 | Goodman et al. | 165/26 |
| 3,470,942 | 10/1969 | Fukada et al. | 165/919 |
| 3,516,485 | 6/1970 | Rhoads et al. | 165/919 |
| 3,608,627 | 9/1971 | Shevlin | 165/63 |
| 3,682,643 | 8/1972 | Foster | 165/918 |
| 3,716,687 | 2/1973 | Constable | 219/10.55 B |
| 3,797,563 | 3/1974 | Hoffman et al. | 165/919 |
| 3,965,969 | 6/1976 | Williamson | 165/919 |
| 3,967,502 | 7/1976 | Moran | 374/158 |
| 4,198,555 | 4/1980 | Bellavoine | 219/10.55 R |
| 4,225,204 | 9/1980 | Bellavoine | 165/918 |
| 4,250,955 | 2/1981 | Plattner et al. | 165/918 |
| 4,262,183 | 4/1981 | Smith et al. | 219/10.55 R |
| 4,297,558 | 1/1981 | Inayama et al. | 219/10.55 R |
| 4,396,817 | 8/1983 | Eck et al. | 219/10.55 R |
| 4,460,814 | 7/1984 | Diesch et al. | 99/419 |
| 4,506,827 | 3/1985 | Jamieson et al. | 165/12 |
| 4,582,971 | 4/1986 | Ueda | 219/10.55 R |

FOREIGN PATENT DOCUMENTS

| | | | |
|---|---|---|---|
| 0040855 | 3/1977 | Japan | 219/10.55 R |
| 2026726 | 2/1980 | United Kingdom | 219/10.55 B |

OTHER PUBLICATIONS

"Amana Touhmatic Radarrange", Sales Brochure Published 1980, Amana Refrigeration Inc.

*Primary Examiner*—John Ford

*Attorney, Agent, or Firm*—Fleit, Jacobson, Cohn, Price, Holman & Stern

[57] ABSTRACT

A self-contained refrigerator-oven for refrigerating and cooking food in the same enclosed chamber, has both heating elements and cooling elements located in the same appliance. The heating elements may be conventional heating elements and/or a convection unit and a microwave unit. Additonally, the apparatus has cooling controls, heating controls, and temperature controls which are activated by a microprocessor, programmable for up to two weeks in advance, so that the cooling elements and the heating elements are subsequently activated to treat the food at particular temperatures for particular specific periods of time. The sequence of heating and cooling may be performed in any desired order. The apparatus includes a battery backup to maintain the time, microprocessor and logic circuits during a power outage and utilizes a frozen food, probe-receiving sheath to facilitate cooking from a frozen state. The apparatus also may have a module containing burners or griddles mounted onto it so that the apparatus can function as a self-contained kitchen unit.

16 Claims, 8 Drawing Sheets

FROZEN FOOD SHEATH

MATERIAL - HEAT RESISTANT/CONDUCTIVE PLASTIC, TEFLON PLATED ALUMINUM

COMBINATION REFRIGERATOR OVEN

This application is a continuation-in-part of Ser. No. 846,853, filed Apr. 1, 1986, now abandoned which is a continuation of Ser. No. 747,797, filed June 24, 1985, now abandoned.

BACKGROUND OF THE INVENTION

1. Field of the Invention

The invention relates to a method of handling food in a kitchen, and more specifically, to the use of an appliance for refrigerating and cooking food automatically, which is a combination of a (1) refrigerator, (2) microwave oven, and (3) conventional/convection oven, controlled by a microprocessor with ability for programming operations up to two weeks in advance.

2. Description of Prior Art

Patents have been issued for combinations for a microwave and conventional oven, microwave and convection oven, microwave cooking with a method for browning, and others, and also for various heating and cooling devices. For example, U.S. Pat. No. 2,504,794 issued to H. E. Berman et al discloses a "crockpot" type combined refrigerator and cooker; U.S. Pat. No. 3,682,643 issued to L. H. Foster is directed to freezing and/or cooking food in the same compartment; U.S. Pat. No. 3,516,485 issued to D. D. Rhoads et al. shows a food container for selectively freezing or heating food; and U.S. Pat. No. 4,582,971 issued to S. Ueda discloses a combination electrical or gas oven-microwave device. However, the spirit or intent of the previous patents do not anticipate the present invention, which is an improvement and a new concept over the prior art.

Controls on ovens are known which allow the user to place food inside the oven up to 12 hours before cooking, and then cook it automatically. To accomplish this, one must be very selective of the type of food used, since most food would stay at room temperature too long before cooking to be safe for consumption.

Thus, a need exists for a method of keeping food cold until the cooking starts. Since many individuals and families are away from home all day, and many travel frequently, the option of leaving food to cook automatically and be ready to serve when desired becomes available to them through this invention, even though their schedules require that preparation be done 24 hours or more ahead of time. The invention would enhance any kitchen, whether or not the owners were routinely away for long periods of time, since it would be advantageous to have a microwave oven, an extra refrigerator/freezer, and an extra conventional/convection oven, as well as the combination, in the space of one appliance.

SUMMARY OF THE INVENTION

This invention is directed to an arrangement of structures which permit the selective cooling and cooking of food. The apparatus of the present invention has contained within it, cooling elements and heating elements along with controls connected to the cooling and heating elements and suitable timing and temperature devices to activate the respective cooling and heating elements.

To use the apparatus to prepare a meal, food is placed inside the heating and cooling chamber. The food is then chilled to a refrigerated or frozen state to prevent spoilage be activating the cooling element. At a predetermined time, as chosen by the operator of the apparatus, the timing and temperature devices are activated so that the cooling element is deactivated and the heating element is activated to cook the food. The operator may program the timing device to turn off the element or to keep the food warm at a lower temperature than the cooking temperature. The operator could further program the apparatus to de-activate the heating element and to then re-activate the cooling element. This procedure would be particularly useful to an operator who had programmed the unit so that the food would be warm and ready to eat at a certain time, but does not require the individual to be present at that time. Since the food would be chilled it would not spoil and could be reheated at a later time. This is particularly suitable if the operator has to stay late at the office or attend a meeting or activity which was previously unanticipated.

In addition, the unit can be designed so that it is a self-contained unit. The self-contained unit may have mounted onto it a module which contains surface burners or griddles to allow further flexibility of the apparatus.

It would also be possible to use gas, rather than electricity, to heat this appliance.

Accordingly, an object of this invention is to provide a new concept and improved method of handling food in a kitchen.

A further object is to simplify meal preparation, by making it possible to prepare food for cooking well in advance, and place it in a refrigerator-oven to remain cold (or frozen) until the predetermined time for cooking to start with cooking subsequently stopping automatically, so that the meal would require no more attention, whether hours or days later, until it is time to serve it.

A further object is to precool food after cooking, if desired.

A further object is to provide with a microwave oven, a refrigerator, and a conventional/convection unit.

Also, it is within the concept of the invention to provide state-of-the-art controls allowing operations to be programmed up to two weeks in advance. The concept uses a microprocessor, interfaced with timer, display, weekly calendar, control panel, and heat sensor/analog digital converters. A power supply provides power to a regulated direct current control circuit, silicon controlled rectifier, and contactors to provide control signals for convection, microwave, refrigeration and resistive heat cycles.

A further object is to include air and probe thermal sensors to maintain food and air temperatures. The probe may be used in the food while cooking, in order to cook to the exact state desired. Also, it is contemplated to include sheaths, into which the probes can fit, which can be inserted into meats, casseroles or other food to be frozen, allowing cooking with the probe from a frozen state. The air temperture sensor also serves to control the air temperature of the chamber when in heat and cool, but not microwave, cycles.

Also, it is contemplated to include a battery pack to maintain program integrity in case of power failure during a cooking cycle.

A further object is to permit cooking of refrigerated food without requiring the food to be kept in particular containers or requiring the containers to be placed at a specific location in the apparatus.

DETAILED DESCRIPTION OF THE PREFERRED EMBODIMENT

Figure 1:
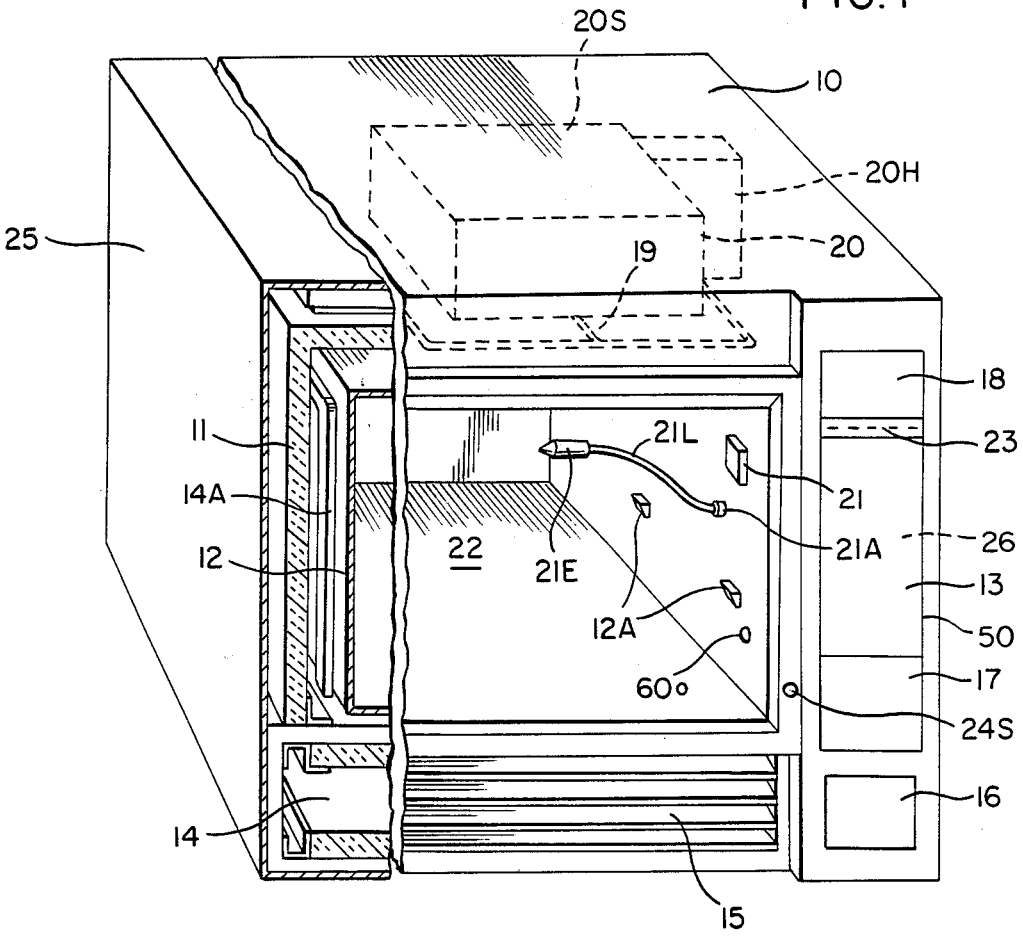
FIG. 1 is a diagrammatic sketch of a preferred embodiment of the present invention, and is a partial section/isometric perspective of the refrigerator-oven appliance in accordance with the invention.

In describing a preferred embodiment of the invention as illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose. It is intended also to cover all modifications falling within the spirit of this invention. It is apparent that variations of the present invention are possible. It is to be understood that, within the scope of the appended claims, the invention may be practiced otherwise than as specifically described. Further, details for assembling the disclosed appliance, which are known in the industry, are not all shown, but it is expected that one skilled in the art could construct the appliance and practice the invention from knowledge of the prior art and the following description and the attached drawings.

Figure 2:
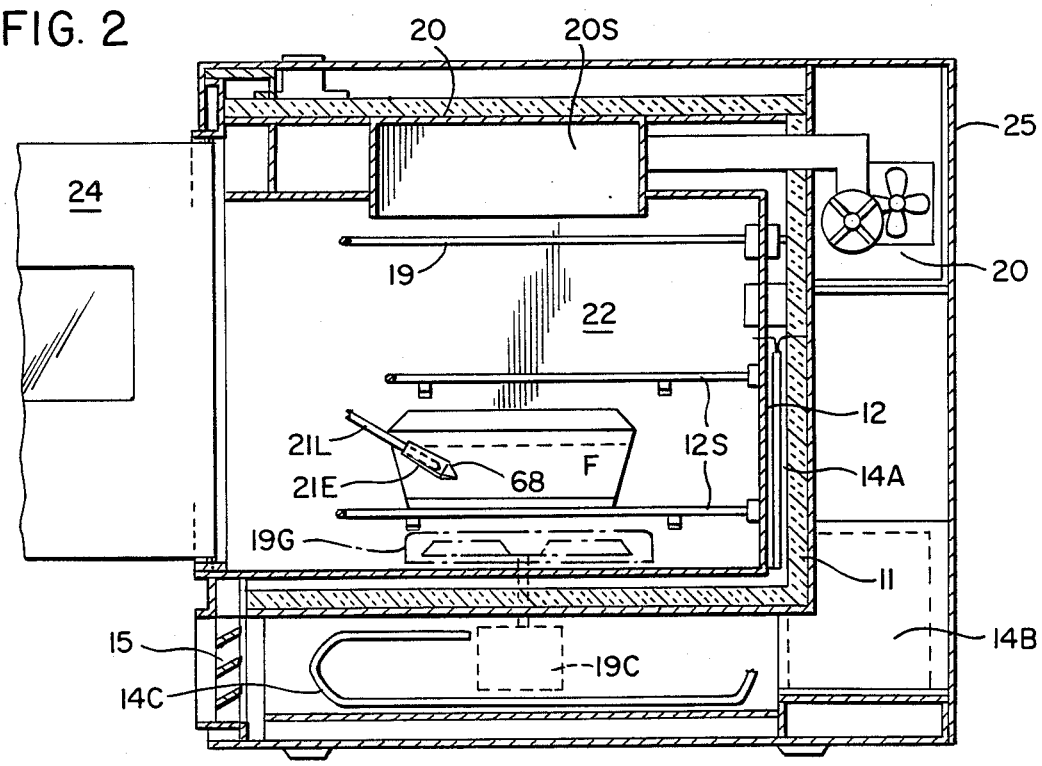
FIG. 2 is a cross section of the present invention cut through the appliance and showing the open food preparation/storage space, microwave and refrigeration components.

Referring now to the drawings, and more particularly to FIG. 1, the basic elements constituting the refrigerator-cooking element appliance are collectively designated as 10. Refrigerator-oven 10 is an appliance which includes an outer cabinet 25 of rectangular shape having top and bottom walls, and rear, back and side walls, with an open front for placing food F (FIG. 2) in the cabinet. The refrigerator-oven 10 has mounted, just inside its outer cabinet 25, a layer of thermal insulation 11. Positioned inside the insulation layer 11 are sets of evaporator cooling coils 14A of a refrigerating unit 14, which are preferably positioned on the inner sides (FIG. 1) and lower back (FIG. 2) of the cabinet 25. Located inward from cooling coils 14A is a suitable heat resistant liner 12. The refrigerating unit 14 also includes a compressor motor 14B (FIG. 2) and a condensor 14C (FIG. 2). An open grille 15 in the front of the cabinet 25 permits intake air flow to the compressor motor and condensor 14C as illustrated in FIG. 2, with expulsion of air being through the back or side of the cabinet in a known manner.

Figure 3:
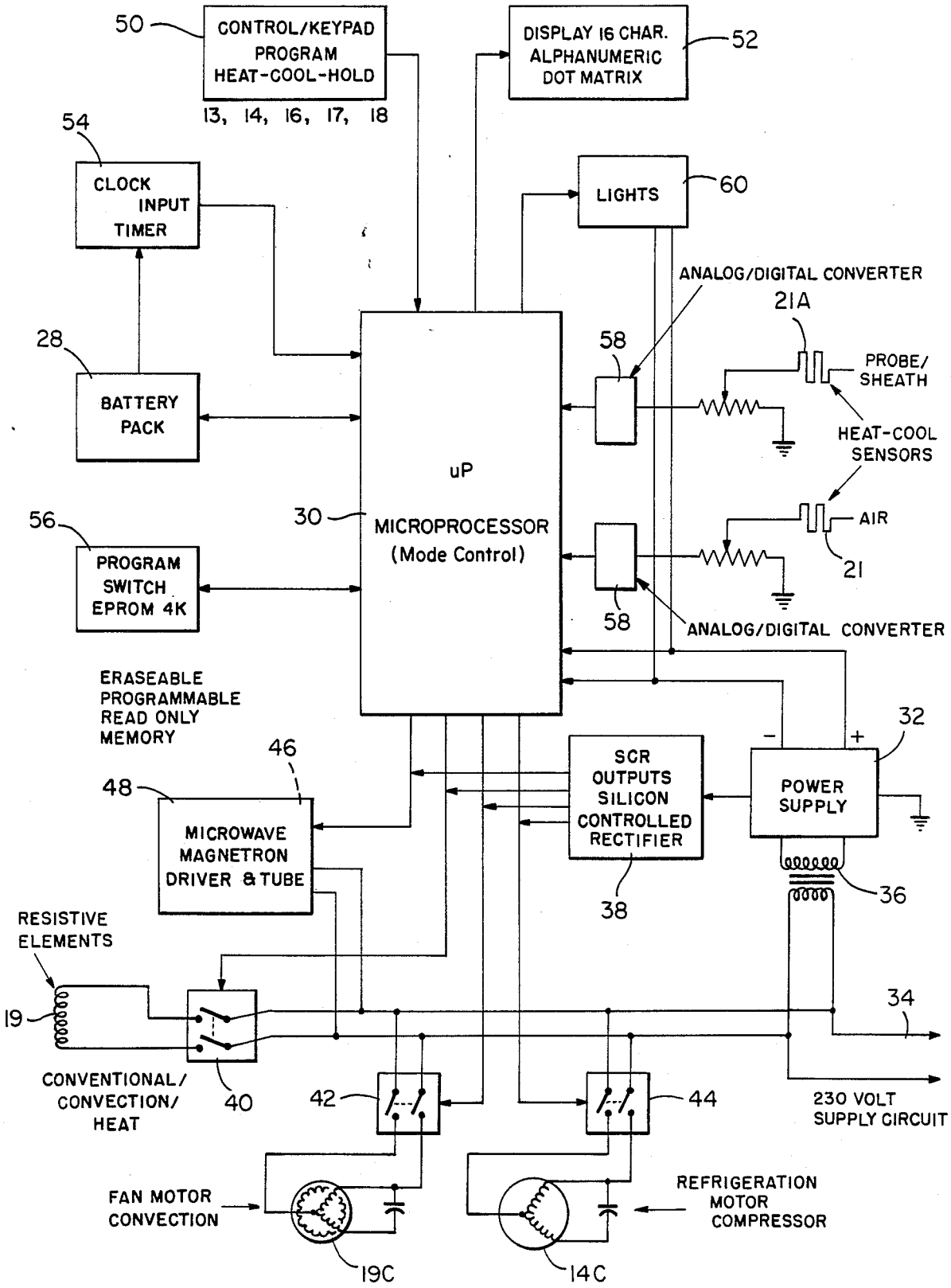
FIG. 3 is a schematic illustration/block diagram of the mode controller/microprocessor, denoting a power source and relays, as well as the basic components/peripherals of the refrigerator-oven.

The inside of liner 12 acts, with a door 24 (shown only in FIG. 2), to form an essentially rectangular enclosure which defines a food preparation-storage compartment or chamber 22 where the food F is placed. Located inside liner 12, and thus in direct communication with the interior of the enclosed chamber 22, is an electrical resistor heating element 19, which is preferably attached to the back wall of the liner. Heating element 19 is located near the top of the inside of the liner 12, provided with isolators to prevent the heating elements from directly contacting liner 12, and provided with hooks (not shown) to prevent contact of the elements with the upper inside surface of the liner. The appliance 10 also includes a convection motor and fan device or until 19C (FIGS. 2 and 3). A residential oven gas burner system 19G, may be provided at the bottom of the liner as an alternate unit.

In addition, a microwave/magnetron device 20, which includes a housing 20H and a source 20S for emitting microwave energy, is located in a space between the top of outer cabinet 25, and the top of liner 12, whereby the microwave emissions source protrudes through the liner in direct communication with the interior of the enclosed chamber 22, to allow an alternative source of heating. The microwave heating source 20S may be used separately or in connection with heating element 19.

The inside of metallic liner 12 includes one or more sets of mounting bracket-isolators 12A upon which a shelf 12S for holding the food F may be inserted, as shown in FIG. 2. Also mounted to liner 12 are an air temperature heat sensor 21 and a heat sensor outlet probe 21A, which are used to control cooling and heating by controlling the temperature of the enclosed chamber 12C and the food F. The probe 21A also includes a heat conductive lead 21L and and a probe end 21E insertable into the food F.

Figure 7:
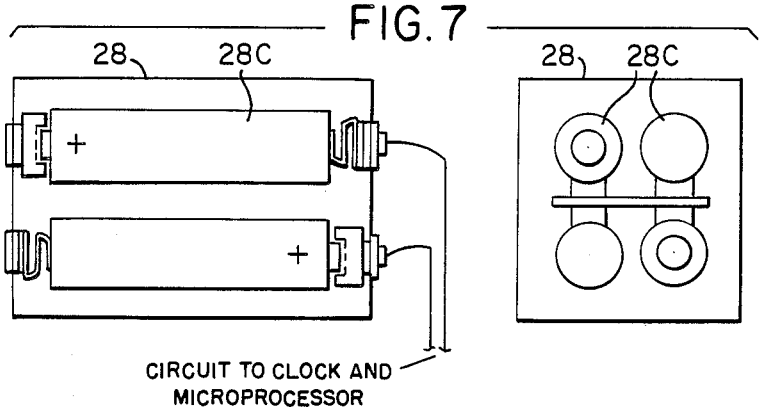
FIG. 7 is a diagrammatic view of a battery pack component.

Located between one side of the liner 12 and a corresponding side of cabinet 25 is a space 26. Located in the space 26 is a control panel-instruction module 13, shown in detail in FIG. 4, and a battery pack compartment 16 for holding a stand-by battery pack 28 (FIG. 7). The control panel-instruction module 13 includes information aids in the form of a data-information strip 17 containing, for example, recommended temperatures for food preparations, etc., a display 18 and a timer 23 having a two week timing capability. In addition, additional components of the refrigerator-oven control system as shown in FIG. 3, may be mounted in the space 26.

FIG. 3 is a schematic illustration (block diagram) of componentry of the refrigerator-oven 10 under operational control by a microprocessor 30. It shows a power supply 32 connected to a supply circuit 34 through a transformer 36, as well as basic peripherals.

In use of the microprocessor 30 to implement the appliance operations as disclosed herein, the microprocessor 30 runs through a preprogrammed time sequence. At completion of a program time, an output (TTL) is given to a silicon controlled rectifier 38 (SCR), which in turn will selectively switch control circuit power to a food preparation phase relay or contact 40, 42, 44 or 46. The relays 40, 42, 44 or 46, in turn, switch line voltage current to the desired component, for example, the heat resistive element(s) 19, the convection device 19C, the refrigerator compressor 14B or a microwave-magnetron driver 48, respetively. From the various schematic/block diagrams shown in FIG. 3 and FIGS. 4-6, and the subsequent description herein, specific circuit board and circuitry design fabrication will be apparent to one skilled in the software-hardware and/or appliance manufacturing fields.

Based on total input (watts/amperes), economy, and at times simultaneous component operations, a 230 volt, 60 cycle incoming supply circuit 34 is required to operate the refrigerator-oven 10. Power supply-circuitry to operate the microprocessor 30, the microwave-magnetron driver 48, the oven heating resistant element(s) 19 and/or the convection device 19C, and the refrigeration unit 14, will be stepped down (regulator-electronic) as necessary.

A system comprising the microprocessor or mode controller 30 has been selected to operate the alternating phases of the refrigerator-oven componentry, in lieu of electro-mechanical time logic switching. The components involved, in addition to those previously mentioned, basically include a control keypad module 50, an alphanumeric display 52 of a 16 character, DOT matrix type, a clock-timer 54, and erasable programmable read only memory 56 (Eprom) having a 4K capacity, analog/digital converters 58 between the air temperature heat sensor 21 and the heat sensor outlet food temperature probe 21A, and lights 60, and involves the use of resistance heat, microwave energy, convection, refrigerator-freezer, hold and signal device techniques.

Figure 4:
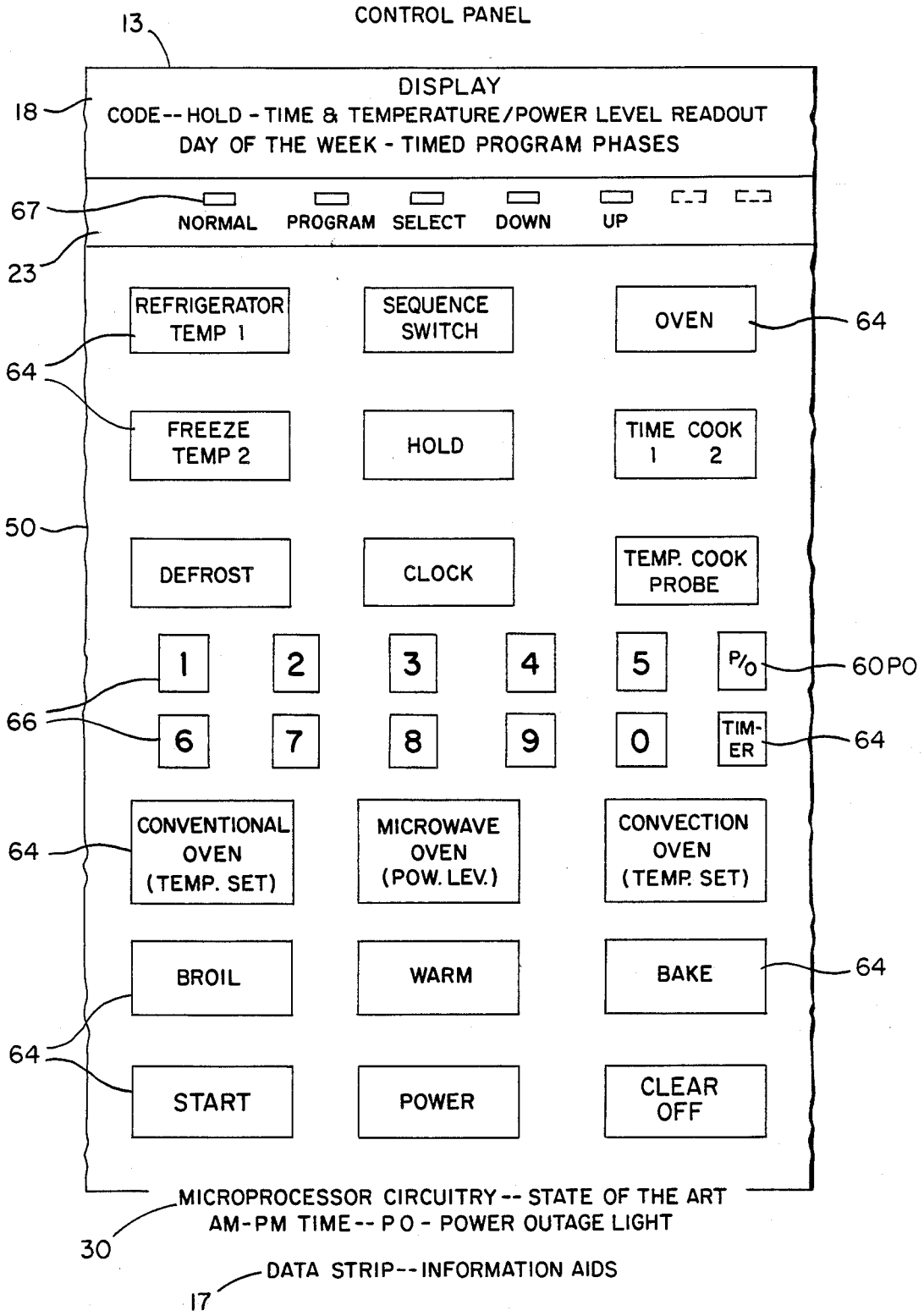
FIG. 4 is an illustrative drawing of the control panel, which states display data and notes information aids in regards to appliance operations and food temperatures.

The control keypad module 50 provides a capability for the instruction signal inputs to the microprocessor 30 for the food processing phases in a timed sequence. The display 52 may be a 16 character, alphanumeric read out/DOT matrix which has the capability of displaying the time of day, day of the week, time program phases (defrost, refrigerate, freeze, cook and hold), and time or temperature, during a cooking cycle in accordance with a preset program. The clock of the clock input-timer 54 may be a digital, real time unit to operate its associated timer mechanism and clock the speed of the microprocessor 30. The lights 60 preferably include an operational light 60*o* (FIG. 1) which forms a part of the refrigerator-oven compartment 22, and a power outage signal light 60PO incorporated into the control keypad module 50, as shown in FIG. 4, with the microprocessor 30 suitably tied to the signal power outage light.

The resistance heating element 19, convection device 19C and the microwave 20 may be of conventional types capable of being programmable for food preparation, with the resistive heating elements, convection device and the microwave being capable of independent or simultaneous operation. The refrigerating unit 14 may be a low volume refrigerator-freezer that is a vapor compression system of a standard type employing a rotary or reciprocal compressor.

The air temperature heat sensor 21 and the heat sensor outlet food temperature probe 21A are used to monitor the oven air and food temperatures, respectively. For this purpose, RTD temperature sensors are commonly available that will function from below 0° F. to 1000° F. Under normal microwave operation (cook mode) the air temperture heat sensor 21 is rendered inoperative so that no sensor read out of the air temperature in the oven is made. The heat sensor outlet temperature probe 21A may be utilized in conjunction with a timed cooking sequence or independently.

The integral-interface of the componentry shown in FIG. 3 and above described affords a variety of menu for a delayed automation type food preparation and frees up the food preparer's time. In this regard, the time factor becomes a variable and can include a two week refrigerator-freezer hold mode, enabling the food F to be placed in the refrigerator-oven 10, kept frozen for the two week period, and then subsequently be automatically prepared at the end of the two week period.

FIG. 4 is an illustrative drawing of the control keypad module 50 reflecting the operational inputs/time controls (of a fingertip touch-type) pertinent to the dual function refrigerator-oven appliance 10 shown and described. FIG. 4 shows the details of the control keypad module 50 typified by the appliance front elevation shown in FIG. 1. The keypad module 50 has touch keypads 64 which reflect those energy phases required to carry out the food preparation/storage cycle. Numbered touch keypads 66 are used to enter refrigeration/cooking times, time of day, oven temperature and microwave power level.

With more specific reference to FIG. 4, the various touch keypads 64 of the control keypad module 50 are intended for use as follows:

Sequence Switch - Touched to enter a refrigerator and/or oven cycle; followed by touching number "1" number keypad 66 or number "2" number keypad 66, respectively, depending on whether refrigeration or cooking is desired first; followed by touching the Refrigerator keypad or the Oven keypad, resepectively, depending on which is to operate first.

Refrigerator - Touched when the refrigerator 14 is to operate with the oven; touched simultaneously with the Sequence Switch keypad when the refrigerator is to operate alone.

Freeze - Touched when the refrigerator 14 is to operate as a freezer.

Defrost - Touched when the refrigerator 14 is to sequence to a defrost cycle.

Oven - Touched when the oven is to operate with the refrigerator 14; touched simultaneously with the Sequence Switch keypad when the oven is to operate without the refrigerator.

Time Cook - Touched when both refrigerator and oven cycles are desired, and/or to set oven cooking time. (Note: cooking times are set on the number keypads 64).

Conventional Oven (Temp. Set) - Touched when operation as a conventional oven (e.g., electrical resistance element 19) is desired; this is followed by entering the desired temperature on the number keypads 66.

Convection Oven (Temp. Set) - Touched when convection device 19C is to operate.

Microwave Oven (Pow. Lev.) - Touched when the microwave 20 is to operate; this may be followed by entering a desired power level other than a standard power level on the number keypads 64.

Broil - Touched when the food is to be broiled.

Bake - Touched when the food is to be baked.

Warm - Touched when th food is to be warmed.

Hold - Touched when the appliance 10 is to be kept in a hold mode without using energy, such as "freeze-to-defrost" or "ambient cooling" after cooking.

Clock - Touched to set the clock input-timer 54 (FIG. 3).

Temp. Cook Probe - Touched when the insertable probe 21A is to be used; this is followed by entering the desired probe operating temperature on the number keypads 66.

Start - Touched after all desired operating mode information has been entered on the keypad module 62.

Clear Off - Touched when it is desired to clear the system and/or change entered information.

Timer-Touched to activate the two-week capability of the timer 23.

With further reference to FIG. 4, the two-week timer 23, which is generally of a known type, includes five control keypads 67 labeled "Normal", "Program", "Select", "Down" and "Up". To use the timer 23 for an up to two weeks timing function (as opposed to up to a normal one week timing function), the "Program" keypad 67 is depressed, causing a symbol "Su" to flash on the display 18. The "Up" or "Down" keypad 67 then is depressed until the desired day of the week appears on the display 18, whereupon the "Select" keypad 67 is depressed to set the day in the timer 23, and "12 AM" then flashes on the display 18. The same procedure then is repeated to select and set the desired hour and minutes in the timer 23. Then, the "Timer" keypad 64 on the control keypad module 50 is depressed, to activate the two-week capability of the timer 23 so that the programmed cooking operation will commence one week later than normal.

Interfacing microprocessor technology with the refrigerator-oven appliance 10 as described herein, provides for a variety of meal programs, including a two week freezer hold capability, as above described. The power outage light 56 is incorporated into the control keypad module 50 to call attention to program deviation, and the data strip 17, which is incorporated into the front of the appliance 10 below the control keypad modul 50, indicates pad code to food temperature settings with an automatic preset program.

Figure 5:
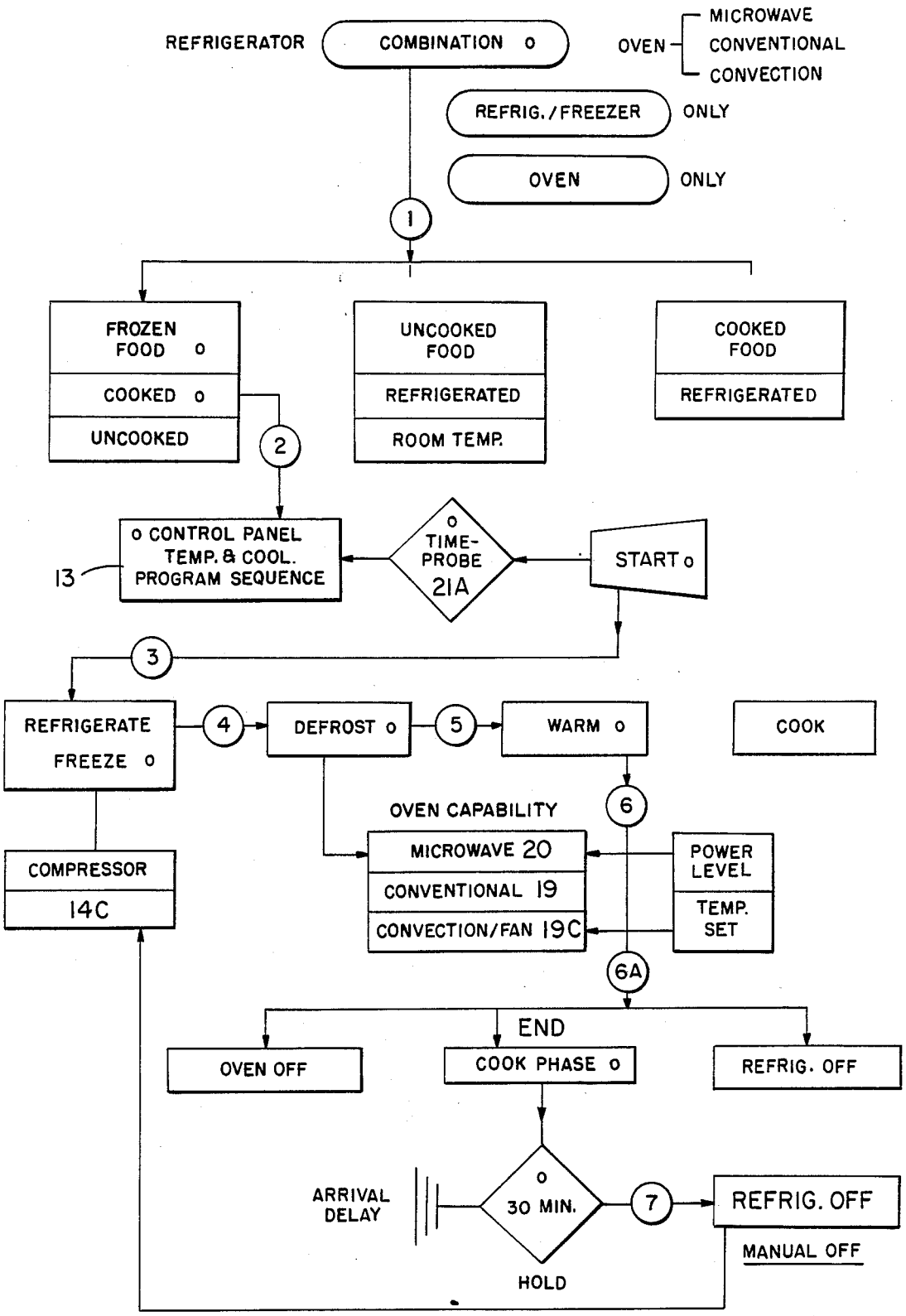
FIG. 5 is a sequence flow chart/algorithm showing a microprocessor controlled program for a combination refrigerator oven in a food preparation/storage cycle.
Figure 6:
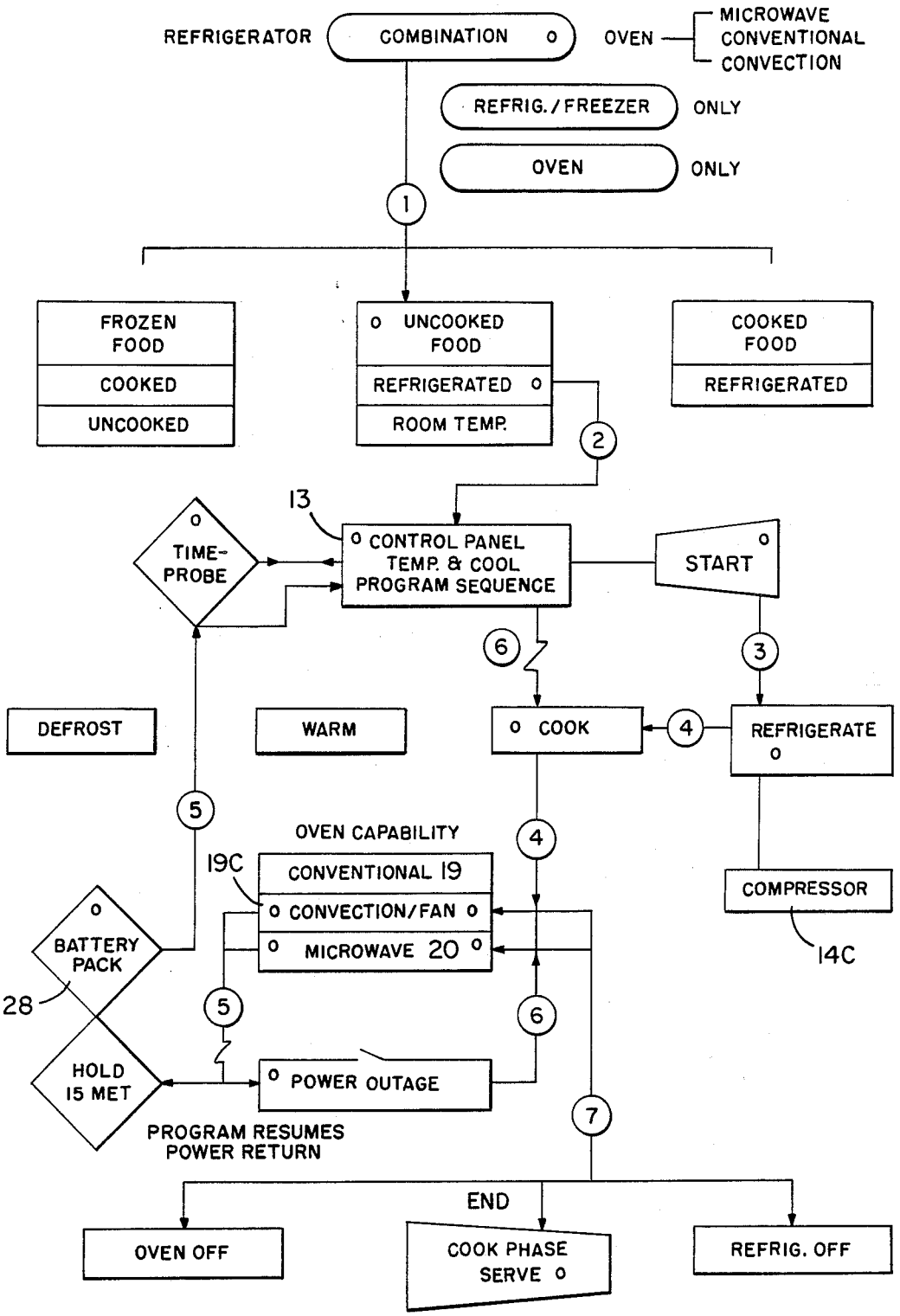
FIG. 6 is a second sequence flow chart/algorithm for a microprocessor controlled program for the combination refrigerator-oven simulating food condition and appliance modes, including temporary power outage, and denotes battery back-up for uninterruptible power to the processor and for display, program logic and time.

FIGS. 5 and 6 show representative examples of flow chart/algorithms for two resepctive food preparation cycles which can be programmed into the microprocessor 30 for preparing food F (FIG. 2) using the combination refrigerator-oven appliance 10. The numbered events 1–7 in the circles designate the various phases of the food preparation cycle.

For example, FIG. 5 shows a food preparation cycle involving the preparation of a ready-to-serve meal from a previously cooked meal that has been frozen, with one of the probe-receiving sheaths 68 (FIG. 8) having been incorporated into the food prior to freezing. The food is to be recooked by a combined use of the convection oven and microwave units 19C and 20. The disclosed food preparation cycle also comtemplates a possible return time delay, and a factor has been included to prevent overcooking and/or food spoilage by placing the appliance 10 into a temporary "Hold" phase upon completion of the food preparation cycle, followed by refrigeration at the end of the "Hold" cycle, if necessary. It is contemplated that the food F will be placed into the appliance 10 the evening before and the appliance programmed to maintain the food frozen, with the food being then defrosted, recooked and held in a "Hold" phase for thirty minutes prior to being ready to serve twenty-four hours (or less) later the following evening.

With reference to the upper portion of FIG. 5, the programming of the combination refrigerator-oven appliance 10 for the food preparation cycle using the control panel 13 (FIG. 4) as shown in FIG. 4, is schematically shown by the events numbered "1" and "2". The flow chart indicates that a dual program entry is required since both refrigeration and cooking phases are involved, namely, first a refrigeration-freeze phase, followed by a cooking phase. Thus, in inserting the required data in the control panel 13 in FIG. 4 as has been previously described, initially the "Sequence Switch" and "Time Cook" keypads 64 are touched simultaneously, followed by touching of the number "1" number keypad 66 since refrigeration is to be the initial mode of operation. The "Freeze Temp 2" keypad 64 then is activated, whereupon a symbol designating "Hours" flashes on display 18. This is followed by selecting the desired time in hours and then minutes using the display 18 and the number keypads 66. To program in the defrosting-cooking phase, the "Defrost" and "Microwave" keypads 64 are activated simultaneously, and the time and microwave power level (if other than standard) for defrosting are entered into the number keypads 66 in a similar manner, using the display 18. The "Warm", "Microwave" and "Convection Oven" keypads 64 then are activated simultaneously/selectively, and the warming time, microwave power levels (if other than standard) and temperature level for probe 21A are selected. The "Hold" keypad 64 is then depressed, and the desired hold time interval of 30 minutes is entered into the display 18 using the number keypads 66, to program in the desired hold time interval. Finally, the "Refrigerator" keypad 64 is depressed so that, in the event the cabinet door 24 (FIG. 2) is not opened at the end of the programmed time period, the refrigerator 14 will be turned on to prevent the food F from spoiling. The temperature probe 21A is then inserted in the frozen food sheath 68 (FIGS. 2 and 8) and the "Start" keypad 64 is depressed to begin the programmed operation, as indicated in the lower portion of FIG. 5.

Thus, initially the food F is maintained in a "frozen" state, as indicated by event 3. The food then is subjected to "defrost" and "warm" phases as shown by events 4 and 5, respectively, followed by combination "microwave" and "convection oven" heating in a "cooking" (or "recooking" in this instance) phase in event 6. As shown by event 6A, at the end of the cooking phase the oven (microwave and convection) and refrigerator are turned off and the appliance 10 is placd in the 30 minute "Hold" phase. However, in the event that the oven cabinet door 24 (FIG. 2) is not opened at the end of the 30 minute "Hold" period, as determined by a sensor 24S (FIG. 1) in the cabinet 25, the refrigerator 14 is again activated and subsequently deactivated when the door is subsequently opened.

FIG. 6 shows a food preparation cycle similar to FIG. 5, involving the preparation of a ready-to-serve meal using uncooked food requiring refrigeration prior to the cooking phase, with the food also to be served approximately 24 hours after programming, but without a "Hold" phase at the end of the cooking phase. As is FIG. 5, a dual program entry is required and the basic information for refrigeration and subsequent cooking is entered into the display 18 using the control keypad module 50 in the same manner as described above for that figure. However, FIG. 6 also shows a program deviation (event 5) caused by a power outage in the cooking phase.

More specfically, during the power outage, the battery pack 28 maintains uninterruptible power, and the clock, microprocessor logic and the display 18 remain on line. During this period, the cooking phase remains on "Hold" as indicated at the lower left corner of FIG. 6. When the power outage has been corrected and power resumes, operation of the program is resumed, with the convection wave and microwave units 19C and 20 being re-energized. In the alternative, however, if power remains off for more than a preselected time, or the cabinet door 24 (FIG. 2) is not opened within the preselected time, such as one hour, the refrigerator 14 is automatically energized by the microprocessor 30 (FIG. 3) to preclude food spoilage. In either event, upon subsequent opening of the cabinet door 24, the system is deenergized as illustrated at the bottom of FIG. 6.

Figure 6A:
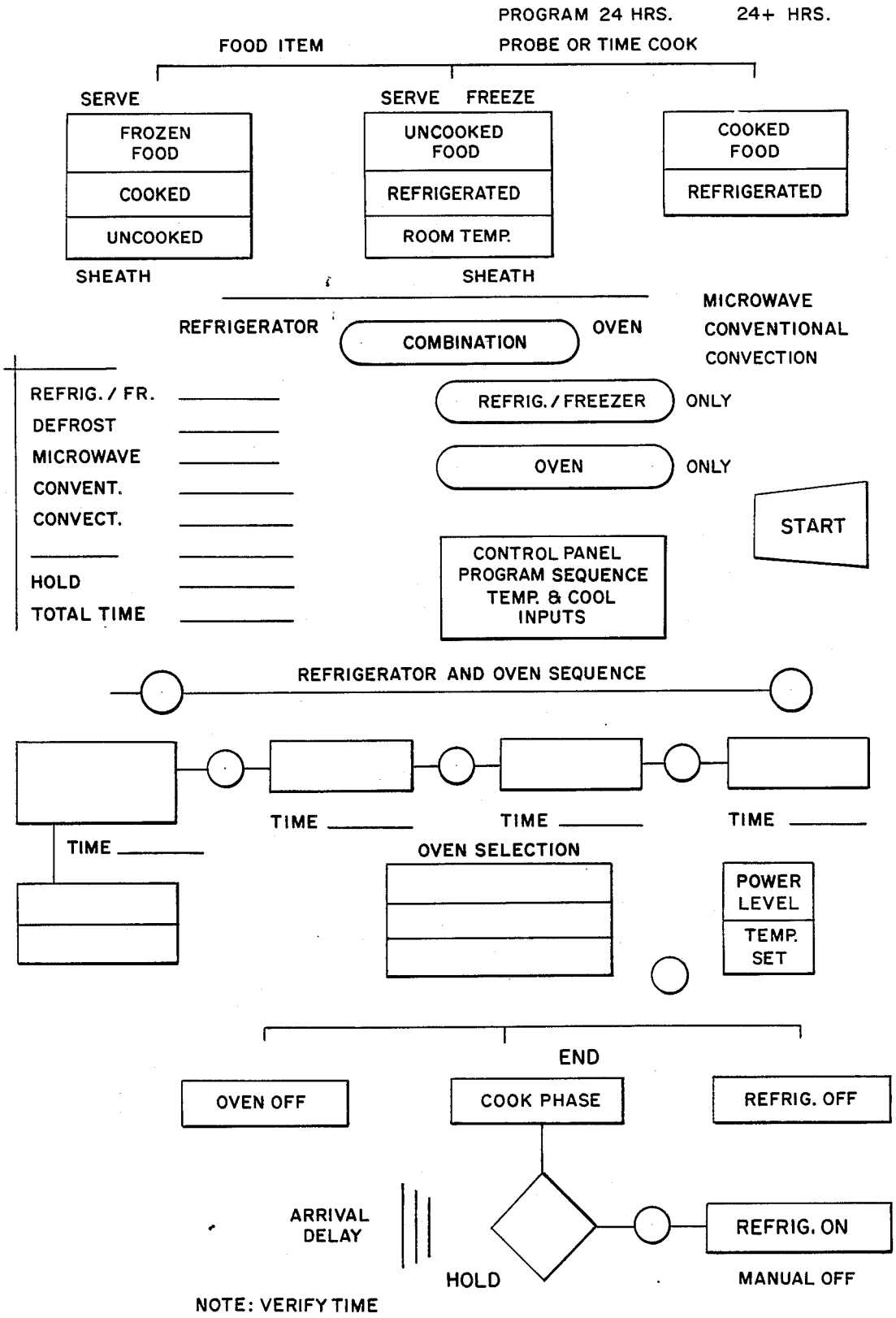
FIG. 6A is a sequence flow chart work sheet for a homemaker to prepare program input relative to a planned meal and required refrigerator-oven operations.

FIG. 6A is a flow chart program guide worksheet, similar to FIGS. 5 and 6, for the homemaker to develop and write out the food preparation-storage program which is to be programmed into the microprocessor 30 (FIG. 7) for a particular food preparation cycle. It includes areas for denoting the types of food involved and necessary mode operations, sequence flow lines, touch keypad 64 entries and associated time intervals, temperature settings and microwave power levels for entry on the number keypads 66.

Referring to FIG. 7, the battery pack 28 provides an economic uninterruptible parallel power source for the microprocessor 30 and the related components of the combination refrigerator-oven appliance 10, so that operation thereof will not be interrupted by temporary power outages, as noted previously. In this regard, the incorporation of the battery pack 28 into the appliance maintains time, microprocessor logic and display functions. More specifically, suitable circuitry (not shown) will permit placing the heat and cool phases on a hold sequence in the event of a power outage. Further, in the event of an extended delay, as determined by a suitable logic circuit, the refrigerating unit 14 will be energized during the delay period, with the refrigerating unit being deenergized and the system returning to a food preparation phase upon power resumption. In the disclosed embodiment of the invention, the battery pack 28 is shown as including four cells 28C each independent of one another, to offer added reliability.

Figure 8:
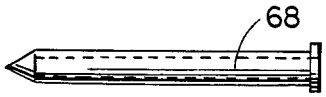
FIG. 8 is a sketch of a frozen food sheath for use in freezing food with a sheath in place so as to permit temperature probe placement into frozen foods for subsequent cooking thereof.

With further reference to FIG. 8, the probe-receiving frozen food sheath 68, which is pointed at one end and open at the other, is desirable where the food F (FIG. 2) is to be frozen prior to cooking, or cooked and then frozen for later use. More specifically, the sheath 68, which may be fabricated of heat resistant/heat conductive plastic and/or metal, such as aluminum plated with a plastic such as that sold by E. I. DuPont under the tradename Teflon, is inserted into the food in the unfrozen state, and the food then is frozen. Subsequently, when it is desired to place the food F in the refrigerator-oven appliance 10 for food preparation, the probe end 21E (FIGS. 1 and 2) of the temperature probe 21A can readily be inserted into the sheath 68 for temperature monitoring purposes, when it is desired to cook or warm the food for use. Thus, the use of the sheath 68 and the probe 21A assure food which has been properly cooked or warmed from a frozen state, without producing dryness due to overcooking, or producing food which is in a cold/lukewarm state.

Figure 9:
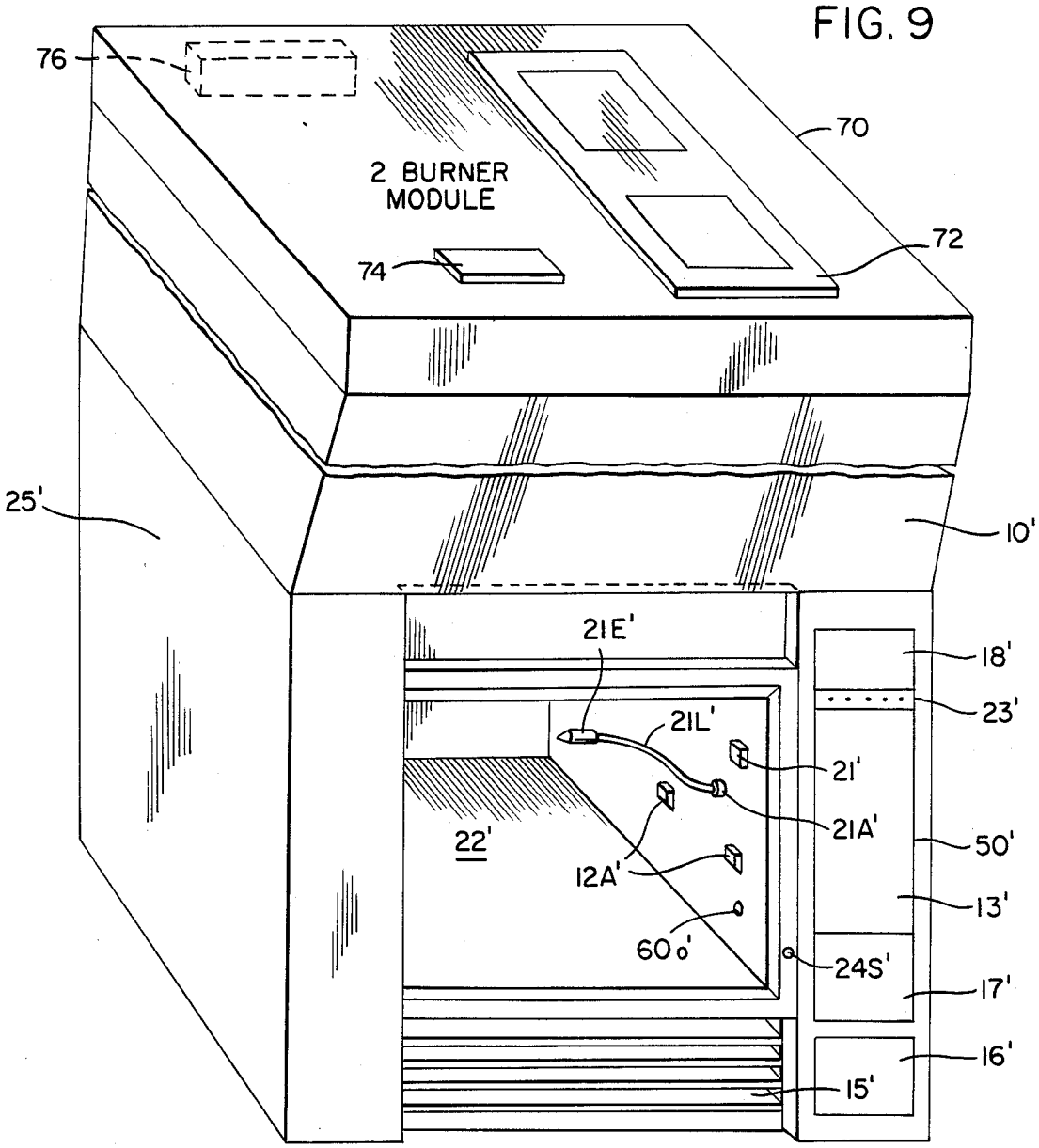
FIG. 9 is a view similar to FIG. 1, showing an alternate embodiment of the invention in which a two-burner module is mounted on the topside of the combination refrigerator-oven.

Referring to FIG. 9, a refrigeration-oven 10′ may include a surface burner module 70 mounted directly onto the top surface of the refrigeration-oven in a suitable manner. The module is preferably 4 inches high and has provided in its surface burners 72 controlled by respective heat control ON-OFF switches 74 on the top of the module and connected to a suitable power pack-and-control circuit 76. In other respects, the refrigerator-oven 10′ may be of the same construction as the refrigerator-oven 10 of FIGS. 1–3; accordingly, those parts of the refrigerated-oven 10 shown in FIGS. 1–4, are identified in FIG. 9 by corresponding reference numerals. One surface burner 72 also could be controlled by the microprocessor 30 with suitable additional control circuits, if so desired, by adding additional keypads 64 to the control keypad module 50. It is envisioned that the refrigerator-oven 10′ then could serve as a complete kitchen for use in a hotel or motel housekeepig room, executive office suite, nurse's work station and the like.

Figure 9A:
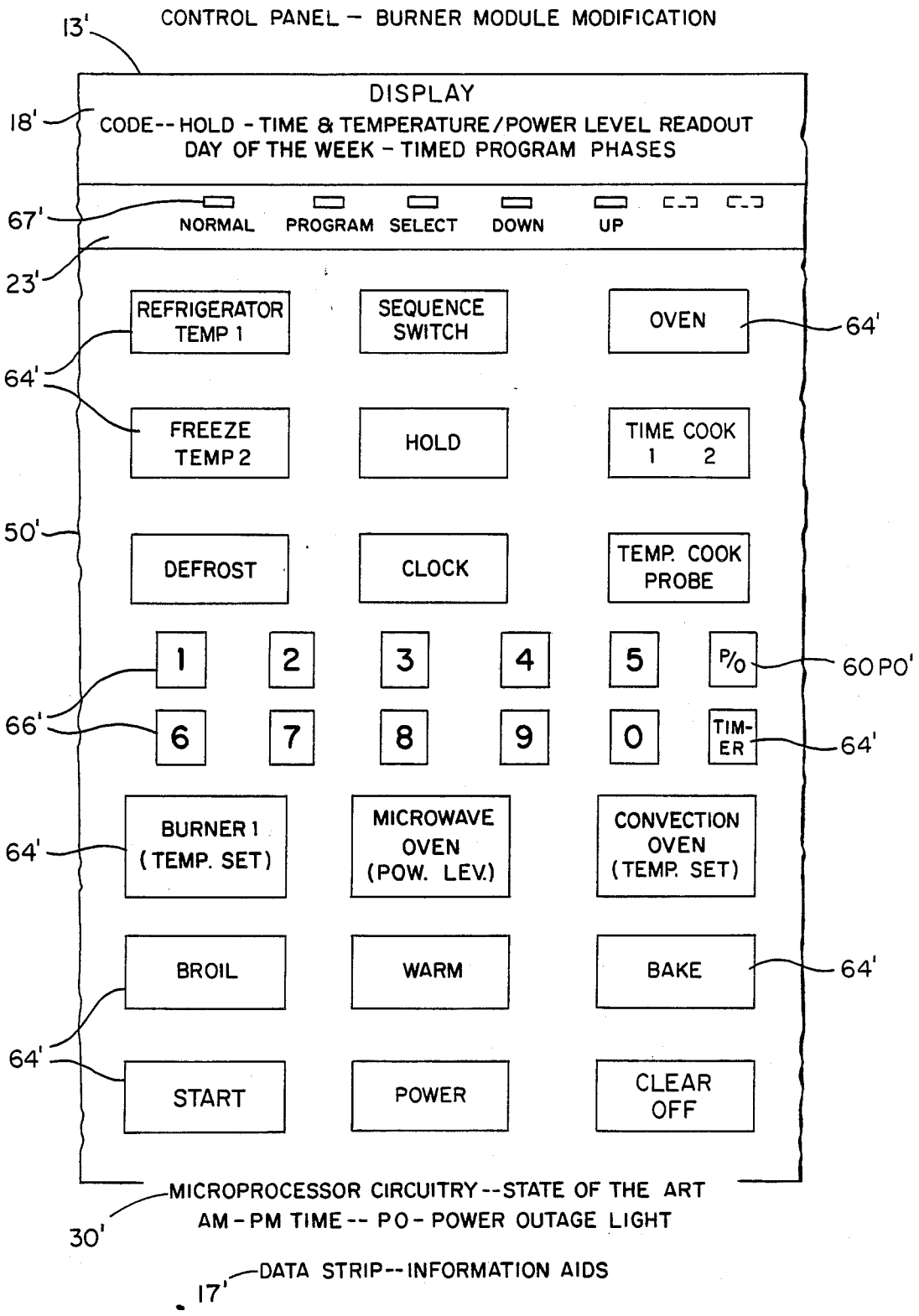
FIG. 9A is a view of the control panel shown in FIG. 4, modified for use with the embodiment of the invention shown in FIG. 9.

For purposes of illustration, FIG. 9A discloses a control panel 13′ essentially identical to the control panel 13 shown in FIG. 4 for the embodiment of the invention shown in FIGS. 1–4, but slightly modified to provide a programmable control for the burner 76 of the refrigerator-oven 10′ and surface burner module 70 embodiment of FIG. 9. Referring to the lower left corners of FIGS. 4 and 9A, in FIG. 4 the "Conventinal Oven (Temp. Set)" keypad 64 has been replaced by a keypad 64′ (FIG. 9A) labeled "Burner 1 (Temp Set)", although it is apparent a separate additional "Burner (Temp. Set)" keypad could be provided. The automatic control of the connected burner 76 then would be controlled by the microprocessor 30 in a manner as above described.

In summary, a combination refrigerator-oven appliance 10, of a highly versatile and flexible type, has been disclosed. The appliance 10 comprises the refrigeration unit 14, the resistive heating element 19, the convection unit 19C and the microwave 20, each of which is operable independently of, or in combination with, one another. The food F to be prepared can be frozen in a separate appliance and placed in the appliance 10 for up to two weeks prior to the time when it is desired that the food be prepared, with the food then subsequently being defrosted and prepared at the desired time two week hence. In the alternative, the food F may be placed directly in the appliance 10 for up to two weeks prior to the time that it is to be prepared, frozen in the appliance 10 by the refrigeration unit 14, and subsequently defrosted and cooked at the desired time two weeks later. The food F, after being cooked, also can be selectively maintained warmed, cooled, rewarmed, placed on "Hold" and even refrozen, as may be desired. The invention also includes the battery backup 28 in the event of a power outage, and involves the use of the probe-receiving sheath 68 to facilitate the preparation of frozen food F. Thus, the combination refrigerator-oven appliance 10 is highly versatile and flexible in use, contributes significantly through the saving of time of the food preparer, and possesses numerous advantageous over the prior art.

From the above, it is apparent that many modifications and variations of the present invention are possible in light of the above teachings. It is, therefore, to be understood that, within the scope of the appended claims, the invention may be practiced otherwise than as specifically described.

What is claimed is:

1. A self-contained, combination refrigerator-cooking oven for selectively cooling and cooking food in the same enclosed chamber, comprising:

a rigid cabinet of essentially rectangular shape and including top, bottom and vertical side walls, with an open front for the placing of food in the enclosed chamber;

a door mounted on the open front of the cabinet and movable between open and closed positions;

thermal insulating means mounted on inner wall surfaces of the cabinet;

a plurality of cooling coils mounted adjacent the thermal insulating means and at least one of the cabinet walls;

a heat-resistant liner having an open front and mounted inside the insulating means to define, with said door, when said door is in its closed position, the enclosed chamber in which the food is placed;

heating means located adjacent a portion of the heat-resistant liner and at least one of the cabinet wall for heating the enclosed chamber, said heating means including a microwave heater in heating communication with the interior of said enclosed chamber so as to be capable of cooking the food placed in said chamber;

a refrigerating unit mounted in the cabinet and connected to said cooling coils;

temperature control means for monitoring and controlling the temperature of said enclosed chamber;

timing control means for selectively activating said refrigerating unit and said heating means in a preselected timed sequence and for preselected periods to provide, selectively, cooling and cooking of the food;

cooling control means responsive to said temperature control means for controlling said refrigerating unit when said refrigerating unit is activated;

heating control means responsive to said temperature control means for controlling said heating means when said heating means is activated; and a control panel module mounted in said cabinet and forming respective parts of said temperature, timing, cooling and heating control means, said control panel module including selector switch means for preselecting the sequence in which said refrigerating unit and said heating means subsequently are to operate, and the time and temperature at which said refrigerating unit and said heating means, respectively, are to operate in each operating cycle thereof, so that said cooling control means and said heating control means control said refrigerating unit and said heating means, respectively, to provide, selectively, freezing, cooling of the food without freezing, defrosting, cooking, recooling and warming of the food in any desired sequence.

2. The self-contained, combination refrigerator-cooking oven as recited in claim 1, wherein the heating means includes an electrical resistance heating element mounted on the interior of said liner in the enclosed chamber.

3. The self-contained, combination refrigerator-cooking oven as recited in claim 1, wherein the heating means includes a gas burner mounted on the interior of said liner in the enclosed chamber.

4. The combination self-contained, combination refrigerator-cooking oven as recited in claim 1, wherein said microwave heater includes a microwave unit mounted in said cabinet between a top of the cabinet and a top of the liner with a microwave source protruding through the top of the liner into the interior of said enclosed chamber, said control panel module also including selector switch means for selecting the power level at which the microwave unit is to operate.

5. The self-contained combination refrigerator-cooking oven as recited in claim 2 wherein the first heating means includes a convection fan unit mounted in the cabinet in conjunction with the electrical resistance heating element.

6. The self-contained, combination refrigerator-cooking oven as recited in claim 1, further comprising a module mounted on the top of the cabinet and including surface burners.

7. The self-contained, combination refrigerator-cooking oven as recited in claim 1, wherein the heating means is comprised of a combination of the following:

an electrical resistance element mounted on the interior of the liner in the enclosed chamber;

said microwave heater being a microwave unit mounted in the cabinet between a top of the cabinet and a top of the liner with a microwave source protruding through the top of the liner into the interior of the enclosed chamber, with the control panel module also including selector switch means for selecting the power level at which the microwave unit is to operate; and a convection unit mounted in the cabinet.

8. The self-contained, combination refrigerator-cooking oven as recited in claim 1, further comprising:

a microprocessor for controlling said temperature, timing, cooling and heating control means; and methodology program guide means for assisting a food preparer in writing input for chronological sequence activations for the self-contained, combination refrigerator-cooking oven.

9. The self-contained, combination refrigerator-cooking oven as recited in claim 9, further comprising a battery pack for providing an uninterruptible parallel power source for the microprocessor.

10. The self-contained, combination refrigerator-cooking oven as recited in claim 1, wherein the temperature control means includes a temperature sensing probe to be inserted in food and an air sensor for determining cooking temperature.

11. The self-contained, combination refrigerator-cooking oven as recited in claim 8, further comprising:

a clock timer for controlling said microprocessor; and a control keypad on said control panel module for setting said clock timer.

12. The self-contained combination refrigerator-cooking oven as recited in claim 1, further comprising:

a "Hold" control keypad on said control panel module for placing the combination refrigerator-cooking oven in a non-energy consuming mode during refrigerating and/or cooking phases.

13. The self-contained, combination refrigerator-cooking oven as recited in claim 1, further comprising:

a timer having a timing capability of up to two weeks, mounted on said control panel module.

14. The self-contained, combination refrigerator-cooking oven as recited in claim 1, wherein said heating means is mounted, at least in part, in said enclosed chamber.

15. The self-contained, combination refrigerator-cooking oven as recited in claim 1, wherein the selector switch means on said control panel module comprises touch control keypads and includes touch control keypads for setting time and temperature which are a series of touch control keypads numbered 0 through 9, respectively.

16. A combination refrigerator-cooking oven for selectively cooling and cooking food in the same enclosed chamber, comprising:

a rigid cabinet of essentially rectangular shape and including top, bottom, and vertical side walls, with an open front for the placing of food in the enclosed chamber;

a door mounted on the open front of the cabinet and movable between open and closed positions;

thermal insulating means mounted on inner wall surfaces of the cabinet;

a plurality of cooling coils mounted adjacent the thermal insulating means and at least one of the cabinet walls;

a heat-resistant liner having an open front and mounted inside the insulating means to define, with said door, when the door is in its closed position, the enclosed chamber in which the food is placed;

heating means located adjacent a portion of the heat-resistance liner and at least one of the cabinet walls for heating the enclosed chamber, said heating means being in heating communication with the interior of said enclosed chamber so as to be capable of cooking the food placed in said enclosed chamber;

a refrigerating unit mounted in the cabinet and connected to said cooling coils;

temperature control means for monitoring and controlling the temperature of said enclosed chamber, said temperature control means including an air temperature sensor for sensing the air temperature within said enclosed chamber, a temperature sensing probe and also including a sheath to be placed in the food prior to initial freezing, for receiving the temperature sensing probe in a close fitting heat-conductive relationship for subsequent cooking of the food;

timing control means for selectively activating said refrigerating unit and said heating means in a preselected timed sequence and for preselected periods to provide, selectively, cooling and cooking of the food;

cooling control means responsive to said temperature control means for controlling said refrigerating unit when said refrigerating unit is activated, to provide cooling of the food; and heating control means responsive to said temperature control means for controlling said heating means when said heating means is activated, to provide cooking of the food.

* * * * *